US006603369B2

(12) United States Patent
Ohira et al.

(10) Patent No.: US 6,603,369 B2
(45) Date of Patent: Aug. 5, 2003

(54) NONRECIPROCAL CIRCUIT DEVICE AND COMMUNICATIONS APPARATUS INCORPORATING THE SAME

(75) Inventors: Katsuyuki Ohira, Kanazawa (JP); Takashi Hasegawa, Kanazawa (JP)

(73) Assignee: Murata Manufacturing Co, Ltd., Kyoto (JP)

( * ) Notice: Subject to any disclaimer, the term of this patent is extended or adjusted under 35 U.S.C. 154(b) by 0 days.

(21) Appl. No.: 09/798,633

(22) Filed: Mar. 2, 2001

(65) Prior Publication Data

US 2001/0033212 A1 Oct. 25, 2001

(30) Foreign Application Priority Data

Mar. 3, 2000 (JP) ..... 2000-059394
May 25, 2000 (JP) ..... 2000-155379

(51) Int. Cl.[7] ..... H01P 1/32
(52) U.S. Cl. ..... 333/1.1; 333/24.2
(58) Field of Search ..... 333/1.1, 24.2; 335/4–5, 104–105

(56) References Cited

U.S. PATENT DOCUMENTS 3,614,675 A * 10/1971 Konishi ..... 333/24.2
6,236,285 B1 * 5/2001 Konishi et al. ..... 333/1.1

FOREIGN PATENT DOCUMENTS

JP 1093308 4/1988
JP 8/330811 * 12/1996

* cited by examiner

*Primary Examiner*—Lincoln Donovan
(74) *Attorney, Agent, or Firm*—Keating & Bennett, LLP

(57) ABSTRACT

A compact nonreciprocal circuit device in which a large amount of attenuation can be obtained at a predetermined frequency band without increasing cost. In the nonreciprocal circuit device, three central conductors are arranged to cross each other on a ferrite member to which a direct-current magnetic field is applied. An inductor is disposed at the bottom of a capacitor connected to a port of a first central conductor. The capacitor and the inductor constitute a series resonant circuit, by which a trap filter for signals passing through an isolator as the nonreciprocal circuit device is constituted. A resonance frequency of the series resonant circuit is set to be approximately twice the central frequency of a pass bandwidth of the isolator so that the second harmonic of a fundamental wave is attenuated. In addition, at the basic wave frequency, the series resonant circuit acts as capacitive impedance. Thus, combination of the capacitive impedance with an equivalent inductance of the first central conductor acts as a matching capacitance with respect to a basic wave frequency.

8 Claims, 8 Drawing Sheets

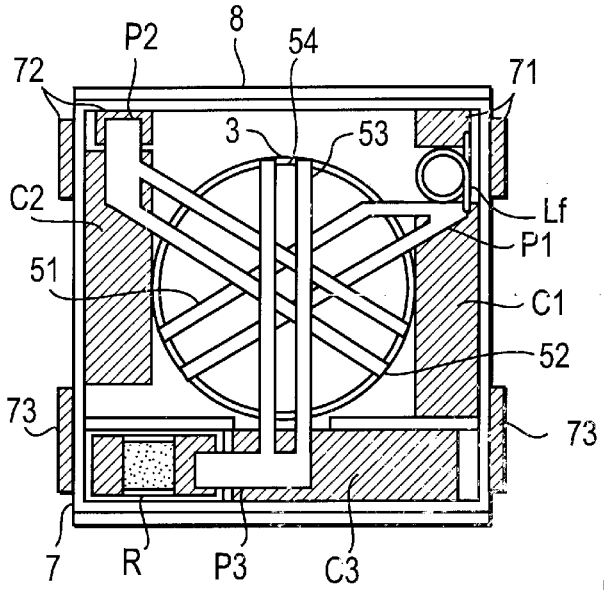
FIG. 12A
PRIOR ART
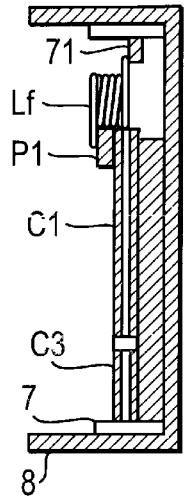
FIG. 12B
PRIOR ART
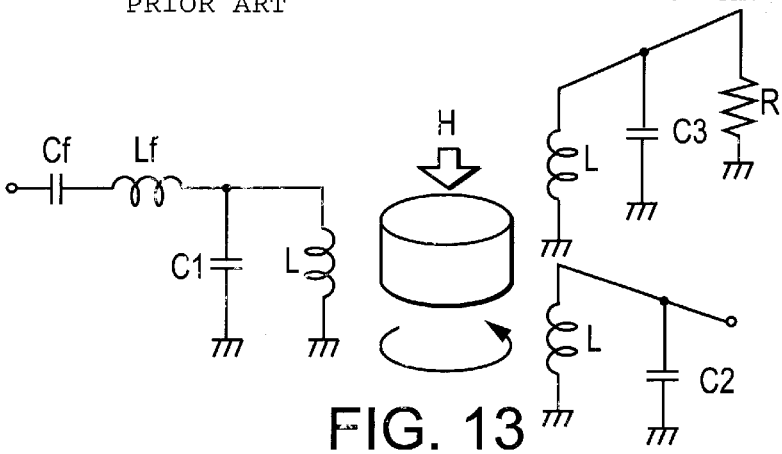
FIG. 13
PRIOR ART
FIG. 14
PRIOR ART
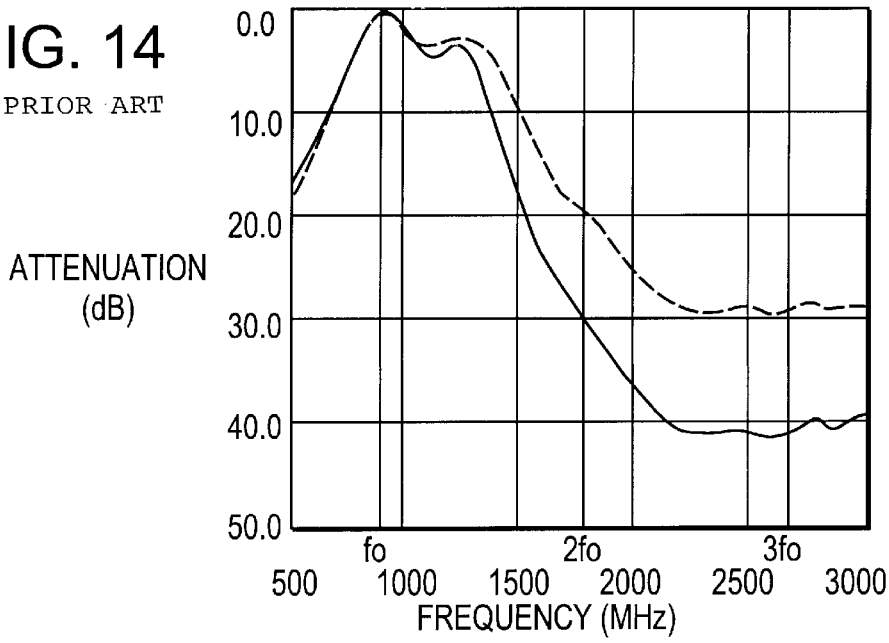

NONRECIPROCAL CIRCUIT DEVICE AND COMMUNICATIONS APPARATUS INCORPORATING THE SAME

BACKGROUND OF THE INVENTION

1. Field of the Invention

The present invention relates to nonreciprocal circuit devices used in a high frequency band such as a microwave band, for example, isolators or circulators. In addition, the invention relates to communication apparatuses incorporating the nonreciprocal circuit devices.

2. Description of the Related Art

In conventional nonreciprocal circuit devices such as lumped-constant isolators and circulators, attenuation in a signal propagation direction is extremely small, whereas attenuation in the opposing direction is extremely large. Conventional nonreciprocal circuit devices having such characteristics are widely used in communication apparatuses to allow oscillators and amplifiers to act in a stable manner and secure functions of the oscillators and amplifiers.

FIG. 8 shows an exploded perspective view of a conventional isolator, and each of FIGS. 9A and 9B show the inner structure of the isolator. FIG. 10 shows an equivalent circuit thereof.

As shown in each of FIG. 8 and FIGS. 9A and 9B, in the lumped-constant isolator, inside a magnetic closed circuit formed by an upper yoke 2 and a lower yoke 8 are arranged a magnetic assembly member 5 composed of central conductors 51, 52, and 53, a ferrite member 54, a permanent magnet 3, and a resin frame 7. Port P1 of the central conductor 51 is connected to an input/output terminal 71 and a matching capacitor C1 and port P2 of the central conductor 52 is connected to an input/output terminal 72 and a matching capacitor C2. The input/output terminals 71 and 72 and the matching capacitors C1 and C2 are disposed in the resin frame 7. Port P3 of the central conductor 53 is connected to a matching capacitor C3 and a termination resistor R. One end of each of the capacitors C1, C2, and C3, and the termination resistor R is connected to grounds 73.

In the equivalent circuit shown in FIG. 10, the ferrite member has a disk shape and a direct-current magnetic field is indicated by the symbol H. The central conductors 51, 52, and 53 are shown as equivalent inductors L. With such a circuit structure, forward-direction characteristics are equivalent to the characteristics of a band pass filter. In frequency bands distant from the pass bandwidth, even in the forward direction, signals are slightly attenuated.

In general, in a conventional communication apparatus, an amplifier used in a circuit of the apparatus always causes distortions to some extent. This is a factor producing spurious components including the second harmonic and the third harmonic of a fundamental wave, by which unnecessary radiation is generated. Since such unnecessary radiation emitted from the communication apparatus causes the malfunction of a power amplifier and interference, standards and regulations for manufacturing the apparatus are predetermined. Thus, it is necessary to suppress the unnecessary radiation below a certain level. In order to prevent unnecessarily radiation, it is effective to use an amplifier having good linearity. However, since such a amplifier costs much, with the use of a filter or the like, usually, unnecessary frequency components are attenuated. However, still, such a filter costs and the size of the apparatus increases. In addition, there is a loss generated by the filter.

Therefore, it is considerable to suppress spurious components by using characteristics of a band pass filter included in an isolator or a circulator. However, it is impossible to obtain sufficient attenuation characteristics in unnecessary frequency bands by using the conventional nonreciprocal circuit device having a basic structure shown in each of FIGS. 8 to 10.

In order to solve the above problems and obtain a large amount of attenuation in spurious frequency bands including the second harmonic and third harmonic of a fundamental wave, there is disclosed a nonreciprocal circuit device in Japanese Unexamined Patent Application Publication No. 10-93308. Each of FIGS. 11, 12A and 12B, and 13 shows an isolator as an example of the nonreciprocal circuit device. FIG. 11 shows an exploded perspective view of the isolator Each of FIGS. 12A and 12B shows the inner structure of the isolator, and FIG. 13 shows an equivalent circuit of the isolator.

Unlike the isolator shown in each of FIGS. 8 to 10, the isolator includes an inductor of for a band pass filter. The inductor Lf is connected between the port P1 of a central conductor 51, a matching capacitor C1, and an input/output terminal 71. As the inductor, a solenoid coil adaptable to miniaturization of the device is used. An isolator applied for the 900-MHz band uses a coil having an inductance of approximately 24 nH. More specifically, a coil used in this isolator is formed by a copper wire having a diameter $\phi$ of 0.1 mm which is wound 9 turns with an external diameter $\phi$ of 0.8 mm.

A capacitor Cf is connected in series to the input/output terminal 71 of the isolator having the above structure. With this connection, as in the equivalent circuit shown in FIG. 13, the capacitor Cf and the inductor Lf form a band pass filter, with the result that the signal components of frequencies distant from the pass bandwidth can be attenuated.

FIG. 14 shows a graph illustrating frequency characteristics of the isolator (a first conventional example) shown in FIGS. 8 to 10 and the isolator (a second conventional example) shown in FIGS. 11 to 13. This graph shows the frequency characteristics of the isolators applied for the 900-MHz band. When compared with the first conventional isolator, in the second conventional isolator, attenuation or the second harmonic (1800 MHz) is improved from 19.3 dB to 28.3 dB, and attenuation of the third harmonic (2700 MHz) is improved from 28.6 dB to 40.1 dB.

As described above, when the inductor is disposed in the nonreciprocal circuit device to form a filter permitting attenuation of unnecessary frequency components, the entire circuit structure can be made smaller than the structure including a single filter disposed outside of the device.

Recently, with an increasing need for further miniaturization of a mobile communication apparatus, there has been a demand for a more compact nonreciprocal circuit device incorporating an inductor for a filter. Thus, it is also necessary to reduce the size of such an inductor. However, when a solenoid inductor is miniaturized, inductance of the inductor becomes smaller, thereby reducing attenuation in the second harmonic and third harmonic of the fundamental wave. In addition, in order to miniaturize such a solenoid inductor without decreasing inductance, it is possibly considerable to provide a solenoid within a magnetic member. However, this arrangement newly requires a magnetic member, and manufacturing of the structure is a difficult task, which increases cost.

SUMMARY OF THE INVENTION

Accordingly, it is an object of the present invention to provide a compact nonreciprocal circuit device in which a large amount of attenuation can be obtained at a predetermined frequency band without increasing cost. It is another object of the invention to provide a communication apparatus using the nonreciprocal circuit device.

The present invention provides a nonreciprocal circuit device including a magnetic member to which a direct current magnetic field is applied, the magnetic member including a plurality of central conductors arranged to intersect one another, and a series resonant circuit including a capacitor and an inductor. The series resonant circuit is connected between at least one of the central conductors and a ground, and has a resonance frequency greater than the central frequency of a pass bandwidth of the nonreciprocal circuit device. The series resonant circuit is formed by directly connecting a cold end of the capacitor and a hot end or the inductor.

Regarding a communication apparatus, the frequencies of major problematic spurious components generated are higher than a basic wave frequency. Thus, when a series resonant circuit as a trap filter having a resonance frequency higher than the central frequency (hereafter referred to as a "basic wave frequency") of a pass bandwidth of the nonreciprocal circuit device is connected between the central conductor and the ground, the spurious signals of frequencies higher than the basic wave frequency flow to the ground via the series resonant circuit. As a result, the spurious components passing through a signal path are attenuated. Usually, the higher the resonance frequency becomes, the smaller the resonant circuit can be made. Thus, when the resonant circuit resonates with the spurious components of frequencies higher than the central frequency to selectively attenuate the spurious components, the resonant circuit can be made smaller than the series resonant circuit resonating with the central frequency on the signal path to selectively pass the signal components as in the case of the conventional nonreciprocal circuit device shown in each of FIGS. 11 to 13. As a result, an inductor forming the series resonant circuit can be disposed on the cold-end side of a capacitor conventionally used for matching to be directly connected to the cold end of the capacitor. In this arrangement, while the inductor can be efficiently contained in the nonreciprocal circuit device, the size of the device can be reduced.

In the nonreciprocal circuit device, the inductor may be a chip inductor. By arranging the chip inductor on the cold-end side of the capacitor, the assembling and connection of components can be facilitated. Thus, simplification of the manufacturing process and cost reduction can be achieved.

In addition, the present invention provides a nonreciprocal circuit device including a magnetic member to which a direct-current magnetic field is applied, the magnetic member including a plurality of central conductors arranged to intersect one another, a series resonant circuit including a capacitor and an inductor, the series resonant circuit being connected between at least one of the central conductors and a ground terminal and having a resonance frequency greater than the central frequency of a pass bandwidth of the nonreciprocal circuit device, and a resin frame for containing the capacitor. In this nonreciprocal circuit device, the inductor is formed by insert-molding an electrode thereof in the resin frame. With this arrangement, since the inductor is integrally formed with the resin frame containing the capacitor, the number of the components can be reduced by one, thereby leading to simplification of the manufacturing process and cost reduction. Moreover, by connecting the cold end of the capacitor to the hot end of the inductor, further simplification of the manufacturing process can be achieved.

In addition, the present invention provides a nonreciprocal circuit device including a magnetic member to which a direct-current magnetic field is applied, the magnetic member including a plurality of central conductors arranged to intersect one another, a series resonant circuit including a capacitor and an inductor, the series resonant circuit being connected between at least one if the central conductors and a ground terminal and having a resonance frequency greater than the central frequency of a pass bandwidth of the nonreciprocal circuit device, and a yoke forming a closed magnetic path. The inductor is formed by cutting a portion of the yoke. With this arrangement, since the inductor is integrally formed with the yoke, the number of components is reduced by one. As a result, the manufacturing process can be simplified and the cost can be reduced. In addition, the cold end of the capacitor may be connected to the hot end of the inductor. Thus, further simplification of the manufacturing process can be achieved.

In the nonreciprocal circuit device, the inductor and the ground terminal may be integrally formed with the same member. With this arrangement, since it is unnecessary to use another member as the ground terminal, the number of used components can be reduced and the distance between the cold end of the inductor and the ground terminal can be shortened. As a result, increase in unnecessary impedance can be suppressed.

Furthermore, in the nonreciprocal circuit device, series resonant circuits may be disposed between two or more central conductors and ground terminals. This increases attenuation of spurious components and permits the spurious components to be attenuated in a broad band.

Furthermore, in the nonreciprocal circuit device, of the two or more series resonant circuits, at least one series resonant circuit may have a resonance frequency different from a resonance frequency of the remaining series resonant circuit. With this arrangement, spurious components generated in a broad frequency band or in a plurality of frequency bands can be attenuated.

Furthermore, in the nonreciprocal circuit device, at least one of the two or more resonant circuits may have a resonance frequency that is substantially twice the central frequency of the pass bandwidth, and at least another resonant circuit may have a resonance frequency that is substantially three times the central frequency of the pass bandwidth.

The major problematic spurious components generated in a communication apparatus are spurious components such as the second harmonic and third harmonic of a basic wave frequency. In order to remove such spurious components distributed in a plurality of frequency bands distant from the basic wave frequency by using a trap filter, the resonance frequency of at least one of the plurality or series resonant circuits is set to be substantially twice the central frequency or the pass bandwidth, whereas the resonance frequency of at least another series resonant circuit is set to be substantially three times the central frequency of the pass bandwidth. In this manner, by matching the resonance frequency of each series resonant circuit with the frequencies of the second harmonic and the third harmonic, spurious components can be efficiently attenuated. In this case, the frequencies of "substantially twice" are included in a range from approximately 1.5 to 2.5 times the central frequency of the pass bandwidth. The frequencies of "substantially three times" are included in a range from approximately 2.5 to 3.5 times the central frequency of the pass bandwidth.

Furthermore, in the nonreciprocal circuit device, an equivalent capacitance to the series resonant circuit at the central frequency of the pass bandwidth may be set as a matching capacitance with respect to the central frequency of the pass bandwidth.

Since the resonance frequency of each series resonant circuit is set to be greater than the central frequency, the resonant circuit acts as a capacitive impedance with respect to the central frequency. Thus, by appropriately designing the inductor and capacitor forming the series resonant circuit, an equivalent matching capacitance with respect to the central frequency can be obtained. With this arrangement, when the series resonant circuit is disposed as a trap filter, it is unnecessary to dispose another matching capacitor. Thus, since the number of used components can be reduced, miniaturization of the device and cost reduction can be achieved.

In addition, the present invention provides a communication apparatus incorporating the nonreciprocal circuit device according to the invention. In this communication apparatus, for example, the nonreciprocal circuit device is disposed as a circulator for dividing transmitted signals and received signals. With this arrangement the communication apparatus of the invention can be made compact while having satisfactory spurious characteristics.

BRIEF DESCRIPTION OF THE DRAWINGS

FIG. 12A shows a top view of the conventional isolator when an upper yoke is removed, and FIG. 12B shows a side-sectional view of the conventional isolator;

FIG. 13 shows an equivalent circuit diagram of the conventional isolator; and FIG. 14 shows a graph illustrating the frequency characteristics of attenuation in each or the above two conventional isolators.

DESCRIPTION OF THE PREFERRED EMBODIMENTS

The structure of an isolator according to an embodiment of the present invention will be illustrated with reference to FIGS. 1 to 4.

Figure 1:
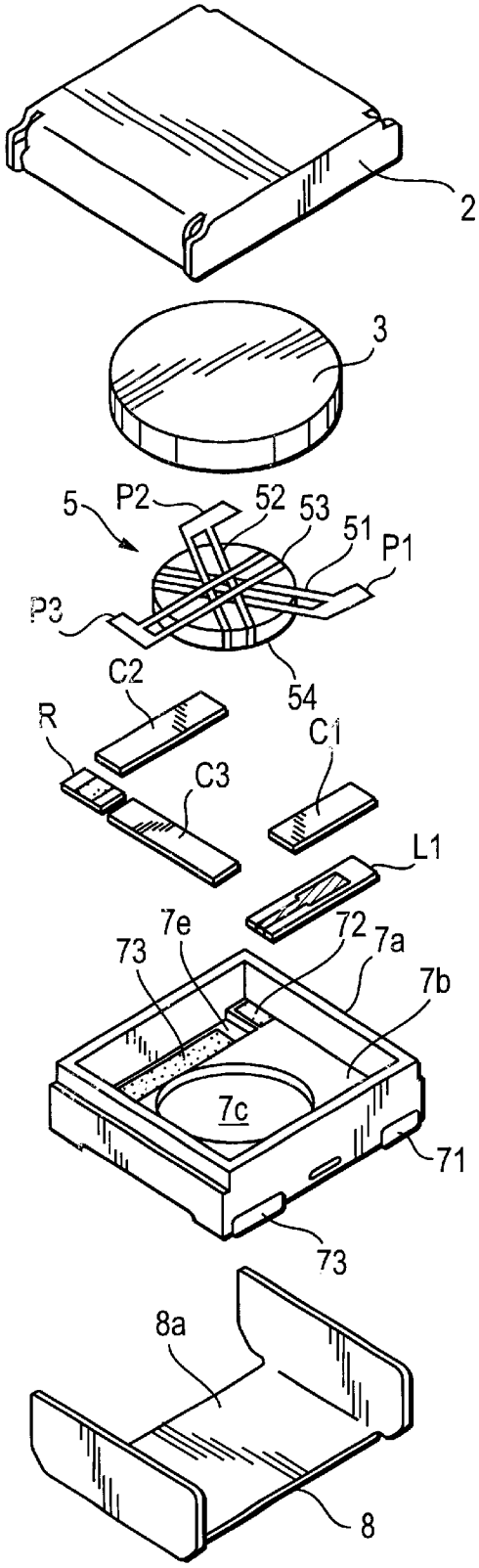
FIG. 1 shows an exploded perspective view of an isolator according to a first embodiment of the present invention.
Figure 2A:
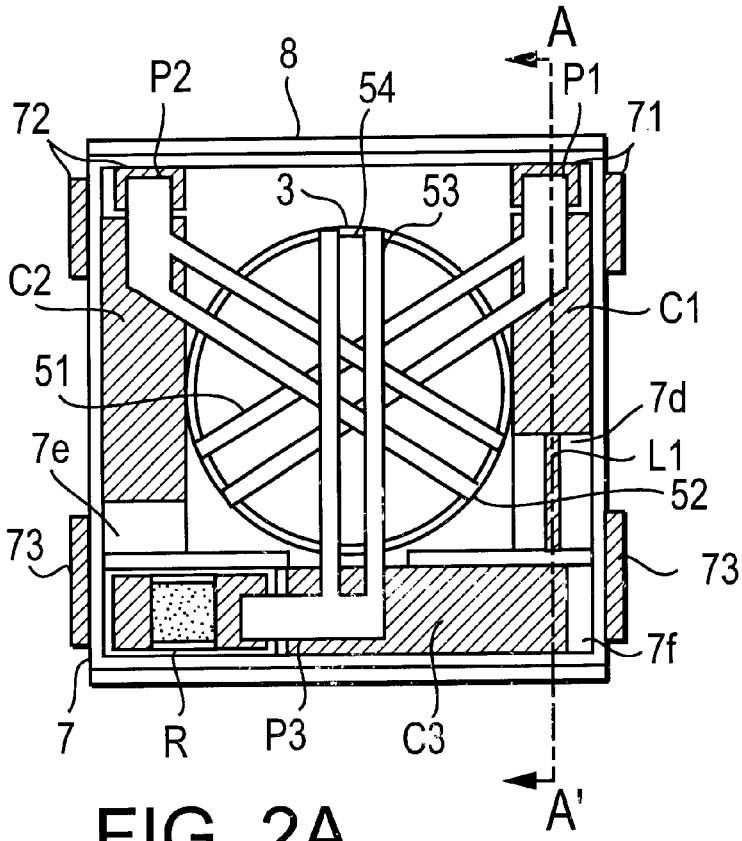
FIG. 2A shows a top view of the isolator according to the first embodiment when an upper yoke is removed.
Figure 2B:
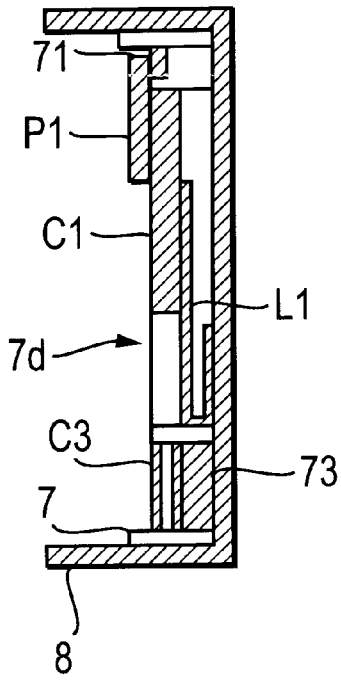
FIG. 2B shows a side-sectional view taken along the line A–A' of the isolator shown in FIG. 2A.

FIG. 1 shows an exploded perspective view of an isolator. FIG. 2A shows a top view of the isolator, in which an upper yoke is removed, and FIG. 2B shows a side-sectional view of the isolator. As shown in FIG. 1 and FIGS. 2A and 2B in this isolator, a disk-shaped permanent magnet 3 is arranged on the inner surface of a box-shaped upper yoke 2 made of a magnetic metal. A magnetic closed circuit is formed by the upper yoke 2 and a substantially U-shaped lower yoke 8 made of a magnetic metal. A resin frame 7 is disposed on a bottom surface 8*a* in the lower yoke 8 as a case. Within the resin frame 7, there are disposed a magnetic assembly member 5, capacitors C1, C2, and C3, a termination resistor R, and an inductor L1.

In the magnetic assembly member 5, three central conductors 51, 52, and 53 has a common ground position. The common ground portion, which has the same configuration as that of the bottom surface of a disk-shaped ferrite member 54, is attached to the bottom surface of the ferrite member 54. On the top surface of the ferrite member 54, the three central conductors 51, 52, and 53 extending from the common ground portion are bent at an angle of 120 degrees from each other via insulating sheets (not shown in the figure), and ports P1, P2, and P3 at top ends of the central conductors 51, 52, an 53 are outwardly protruded. A direct-current magnetic field is applied to the magnetic assembly member 5 with the above permanent magnet 3 such that magnetic flux passes in the thickness direction or the ferrite member 54.

The resin frame 7 is made of an electrically insulating member and is formed by integrating a bottom wall 7*b* with a rectangular frame-shaped side wall 7*a*. A round insertion through-hole 7*c* is formed at the center of the bottom wall 7*b*. In addition, a rectangular cut-away portion 7*d* is formed at a right-edge portion of the bottom wall 7*b*, and a rectangular recess 7*e* is formed in a left-edge portion of the bottom wall 7*b* and a rectangular recess 7*f* is formed in a front-edge portion thereof.

The magnetic assembly member 5 is inserted in the round insertion through-hole 7*c*. The common ground portion of the central conductors 51, 52, and 53, which is disposed on the bottom of the magnetic assembly member 5, is connected to the bottom surface 8*a* or the lower yoke 8 as a case by soldering or the like. In addition, input/output terminals 71 and 72, and ground terminals 73 are insert-molded in the resin frame 7. The input/output terminals 71 and 72 are positioned at the rear of each of the right-and-left side surfaces of the resin frame 7, and the ground terminals 73 are arranged at the front thereof. One end of each of the ground terminals 73 is exposed inside the recesses 7*e* and 7*f* of the bottom wall 7*b*, and the remaining and thereof is exposed on external surfaces at the right-and-left front parts of the side wall 7*a*. One end of the input/output terminal 71 is exposed on an upper surface of the bottom wall 7*b* at the back of the right-edge cut-away portion 7*d* and the remaining end thereof is exposed on an external surface at the right-back part of the side wall 7*a*. One end of the input/output terminal 72 is exposed on the upper surface of the bottom, wall 7*b* at the back of the left-edge recess 7*e* and the remaining end thereof is exposed on an external surface at the left-back part of the side wall 7*a*.

A chip capacitor C1 and an inductor L1 are stacked in the cut-away portion 7*d*. A lower-surface electrode as the cold end of the capacitor C1 is electrically connected to an upper-surface electrode as the hod end of the inductor L1. A lower-surface electrode as the cold end of the inductor L1 is connected to the lower yoke 8. The inductor L1 is formed by disposing electrodes on main surfaces of a dielectric substrate. A matching chip capacitor C2 is arranged in the recess 7*e*. The cold end (lower-surface electrode) of the matching chip capacitor C2 is connected to the ground terminal 73. A matching chip capacitor C3 and a termination chip resistor R are aligned in the recess 7*f*. The cold end (lower-surface electrode) of the matching chip capacitor C3 and the cold end (one-end-side electrode) of the termination chip resistor R are connected to the ground terminals 73, respectively.

The port P3 of the central conductor 53 is connected to the hot end (upper surface electrode) of the capacitor C3 and the hot end (the remaining-end-side electrode) of the termination resistor R. The port P1 of the central conductor 51 is connected to the hot end (upper-surface electrode) of the capacitor C1 and the input/output terminal 71. The port P2 of the central 52 is connected to the hot end (upper surface electrode) to the capacitor C2 and the input/output terminal 12. The ports P1, P2, and P3 are formed in a stepped shape so that the ports P1, P2, and P3 are flush with the upper surface of the capacitors C1 C2, and C3.

Figure 3:
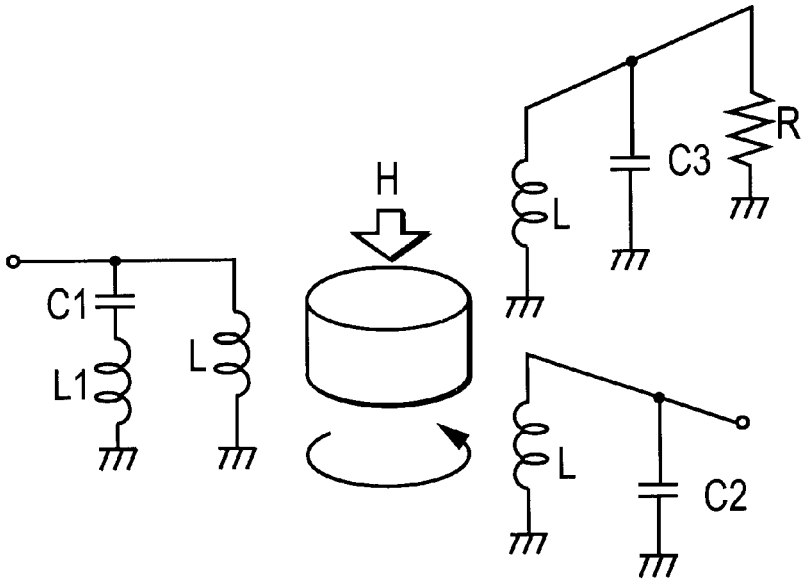
FIG. 3 shows an equivalent circuit diagram of the isolator.

FIG. 3 shows an equivalent circuit diagram of the above isolator. With the connecting arrangement described above, a series resonant circuit including the capacitor C1 and the inductor L1 is formed as a trap filter between the input/output terminal 71 and the ground terminal 73. Of signals input from the input/output terminal 71 or the central conductor 51, signal components in the vicinity of a resonance frequency of the series resonant circuit flow into the ground terminal 73 by the trap filter, with result that the signal components are greatly attenuated. Inductances shown in FIG. 3 are equivalent inductances formed by the ferrite member 54 and the central conductors 51, 52, and 53.

The series resonant circuit including the inductor L1 and the capacitor C1 has a resonance frequency greater than the central frequency (a basic wave frequency) of a pass bandwidth of the isolator as a nonreciprocal circuit device. Thus, at the central frequency of the pass bandwidth, the series resonant circuit acts as capacitive impedance to form a matching circuit associated with the inductance L.

When the isolator of this embodiment is applied for the 900 MHz band, arrangement is made such that the inductor L1 is 0.2 mm wide and 2.0 mm long. With this arrangement, an inductance of 1.1 nH is obtained. Then, the capacitance of the capacitor C1 is set to be 6.7 pF. As a result, the resonance frequency of the series resonant circuit including the inductor L1 and the capacitor C1 is 1.9 GHz. Thus, the series resonant circuit can function as a trap filter attenuating the second harmonic of the 900 MHz-band frequency or the frequency components higher than that. In addition, since the capacitance of the series resonant circuit equivalently is approximately 9 pF in the case of the 900-MHz band, the series resonant circuit can act as a matching capacitance with respect to signals of the 900-MHz band.

Figure 4:
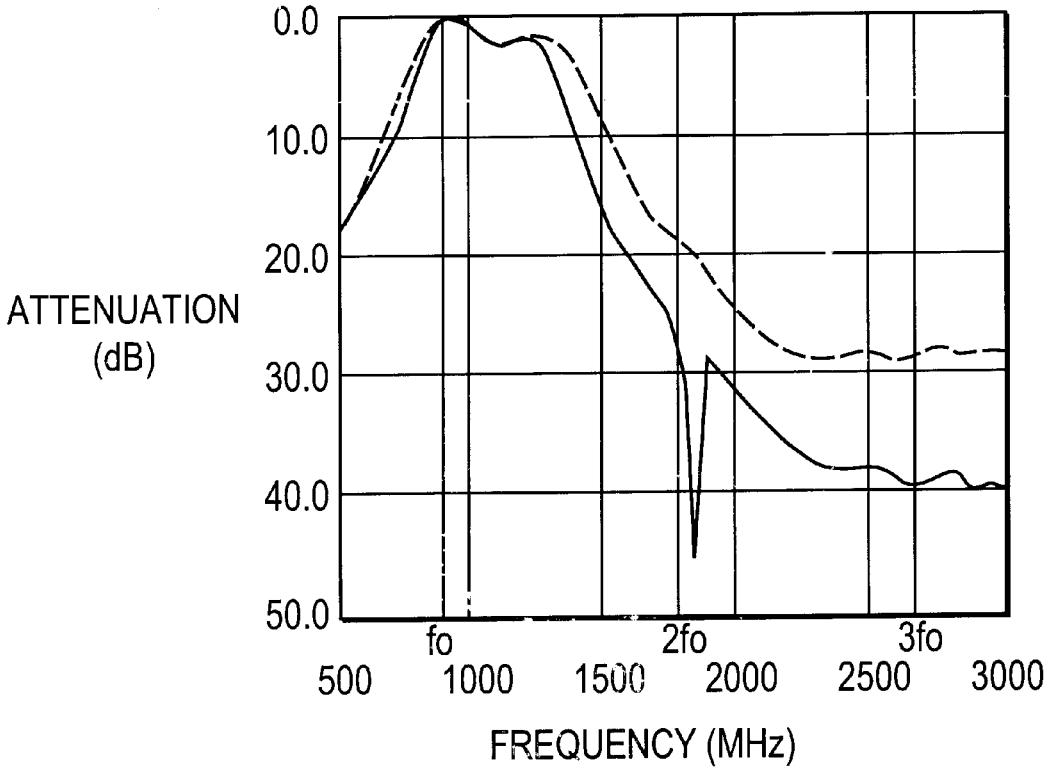
FIG. 4 shows a graph illustrating the frequency characteristics of attenuation in each of the above isolator and a conventional isolator.
Figure 8:
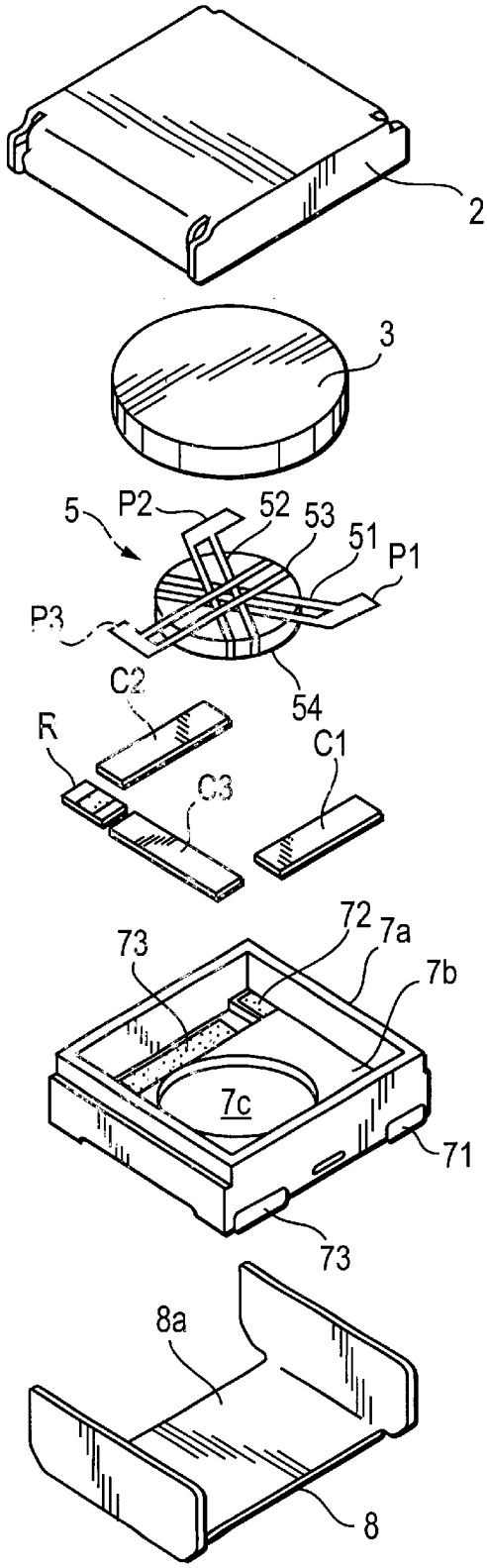
FIG. 8 PRIOR ART
FIG. 8 shows an exploded perspective view of a conventional isolator.
Figure 9A:
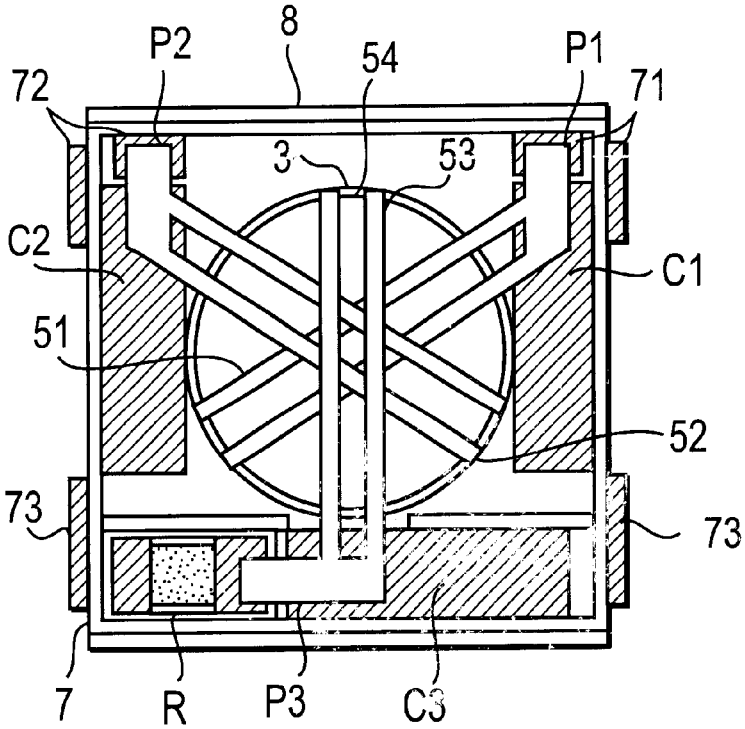
FIG. 9A PRIOR ART
FIG. 9A shows a top view of the conventional isolator when an upper yoke is removed.
Figure 9B:
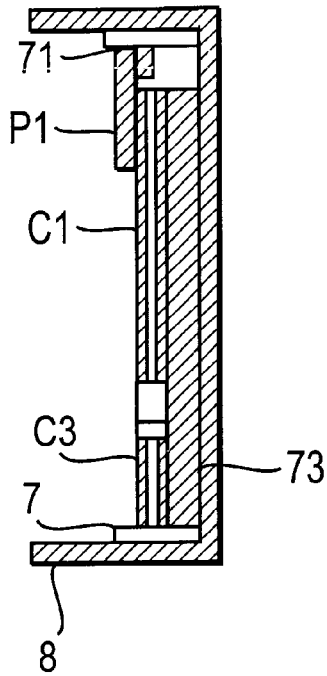
FIG. 9B PRIOR ART
FIG. 9B shows a side-sectional view of the conventional isolator.
Figure 10:
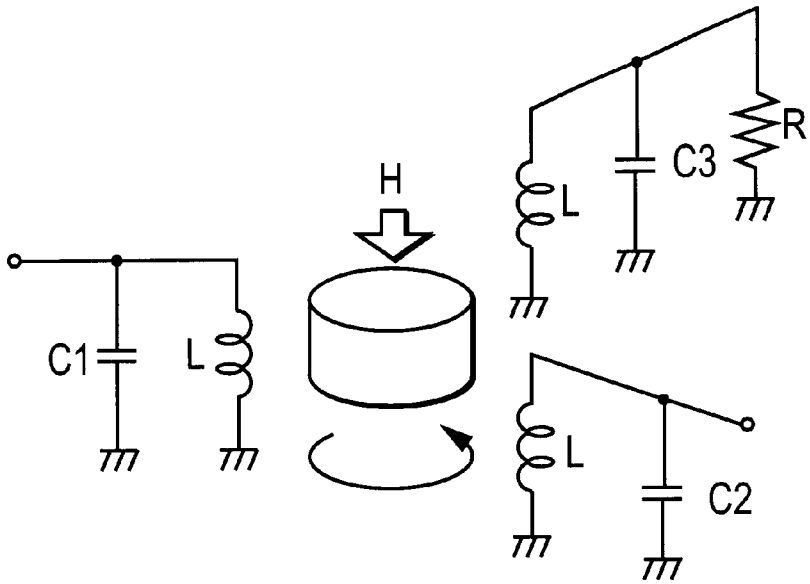
FIG. 10 PRIOR ART
FIG. 10 shows an equivalent circuit diagram or the conventional isolator.
Figure 11:
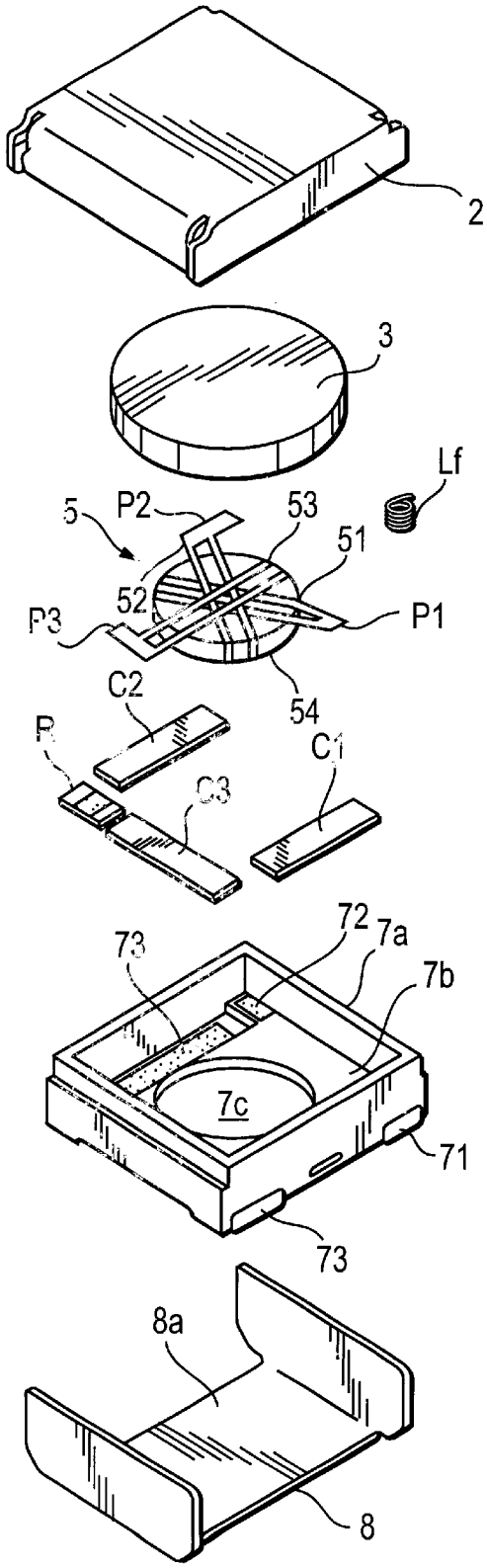
FIG. 11 PRIOR ART
FIG. 11 shows an exploded perspective view of another conventional isolator.

FIG. 4 shows a graph illustrating attenuation characteristics in signal-transmission directions in the isolators applied for the 900-MHz band. In FIG. 4, a solid line indicates characteristics of the isolator according to this embodiment, whereas a broken line indicates characteristics obtained when the conventional isolator shown in each of FIGS. 8 to 10 is applied for the 900-MHz band. In this case, when the used basic wave frequency is set to be 900 MHz, in the conventional isolator having no trap filter including the series resonant circuit, the attenuation of the second harmonic is approximately 19.3 dB and the attenuation of the third harmonic is approximately 28.6 dB. In contrast, in the isolator according to the present embodiment, the attenuation of the second harmonic is approximately 29.5 dB and the attenuation of the third harmonic is approximately 39.0 dB. Thus, the isolator according to the embodiment permits a large amount of attenuation to be obtained.

In this embodiment, the inductor L1 is formed by disposing electrodes thereof on main surfaces of the dielectric substrate. However, instead of the dielectric substrate, a magnetic substrate may be used. In addition, electrodes may be formed not only on the main surfaces of a substrate but also inside the substrate. In addition, although the lower electrode of the inductor L1 is directly connected to the lower yoke 8, the lower electrode thereof may be connected to the ground terminal 73. The lower yoke 8 as a case may be integrated with the resin frame 7 by insert-molding the lower yoke 8 in the resin frame 7. Furthermore, the ground terminal may be disposed on the lower yoke 8.

Figure 5A:
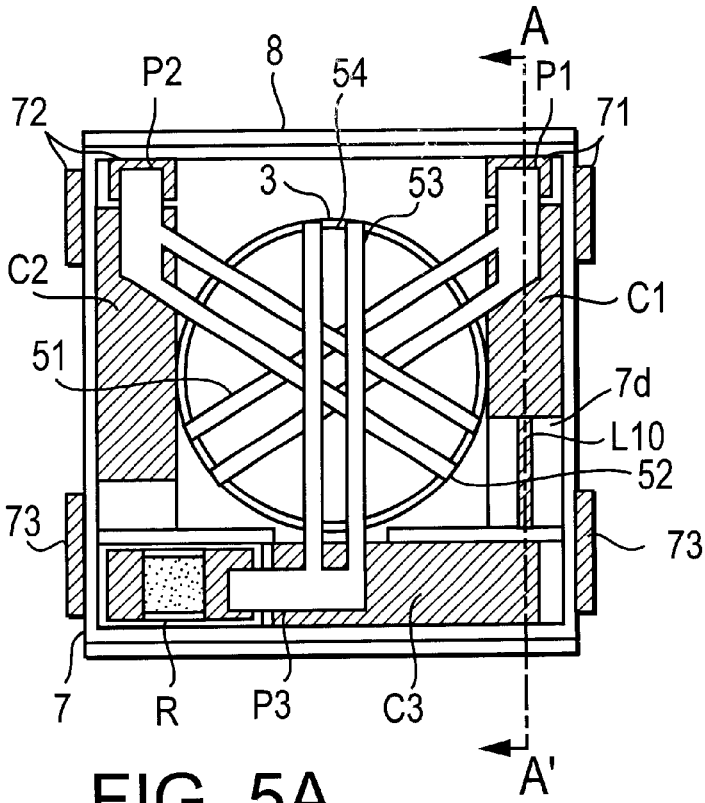
FIG. 5A shows a top view of an isolator according to a second embodiment of the invention when an upper yoke is removed.
Figure 5B:
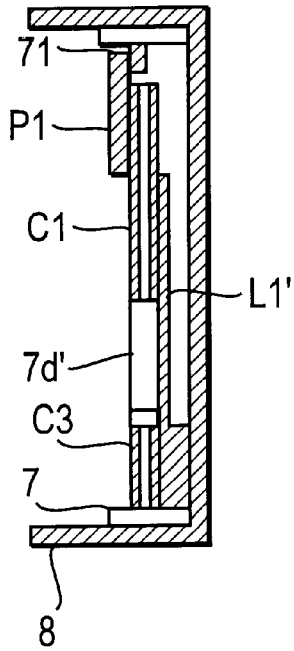
FIG. 5B shows a side-sectional view taken along the line A–A' of the isolator shown in FIG. 5A.

Each of FIGS. 5A and 5B shows an isolator according to a second embodiment to the invention. The isolator is formed integrally by insert-molding an inductor L1' in a bottom wall 7*b* of a resin 7. In the second embodiment, the same components as those shown in the first embodiment have the same reference numerals, and the explanation thereof will not be repeated. Unlike the first embodiment, as an alternative to the cut-away portion 7*d*, a recess 7*d*' is provided in the bottom wall 7*b* of the resin frame 7. That is, the right edge of the bottom wall 7*b* is not allowed to reach a lower yoke 8 so that a part of the bottom wall of the resin frame is remained. In addition, the inductor L1' is insert-molded in the bottom wall of the recess, and a capacitor C1 is arranged in the recess 7*d*' to connect the cold end of the capacitor C1 and the hot end of the inductor L1'. The cold end of the inductor L1' is connected to a ground terminal 73. As shown here, by integrally forming the inductor L1' in the frame 7, when a series resonant circuit is constituted by the inductor L1' and the capacitor C1, the number of used components can be reduced as compared with the case in which an inductor is a chip component.

The cold and of the inductor L1' may be connected to the lower yoke 8. In this case, a ground terminal may be disposed on the lower yoke 8.

In addition, the inductor L1' and the ground terminal may be integrally formed with the same member. In this case, all ground terminals may be formed by using the same member or only the inductor L1' and one ground terminal may he integrally formed with the same member.

Furthermore, the lower yoke 8 may be insert-molded in the resin frame 7 to be integrated with each other.

Figure 6A:
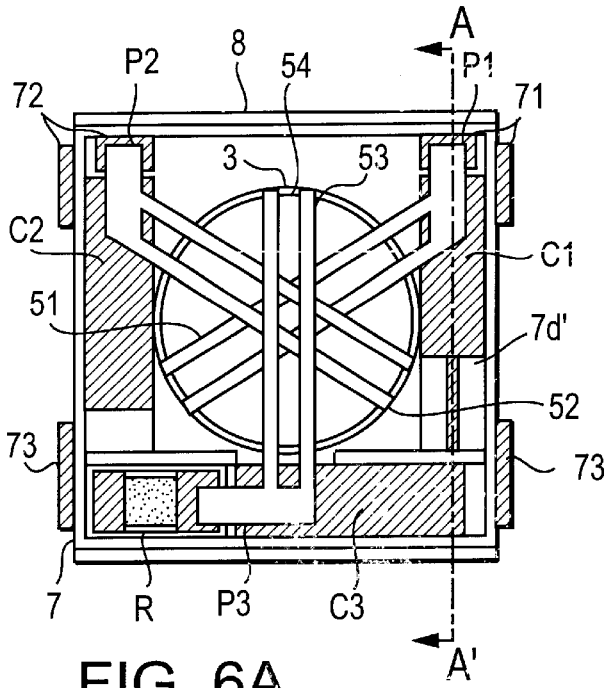
FIG. 6A shows a top view of an isolator according to a third embodiment of the invention when an upper yoke is removed.
Figure 6B:
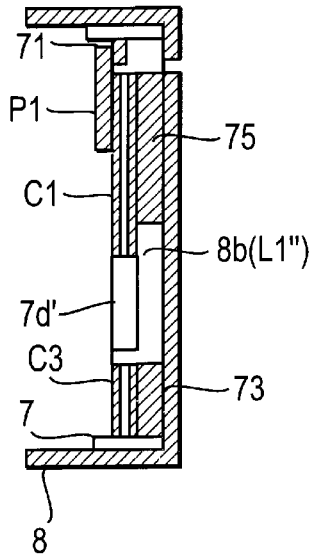
FIG. 6B shows a side-sectional view taken along the line A–A' of the isolator shown in FIG. 6A.
Figure 6C:
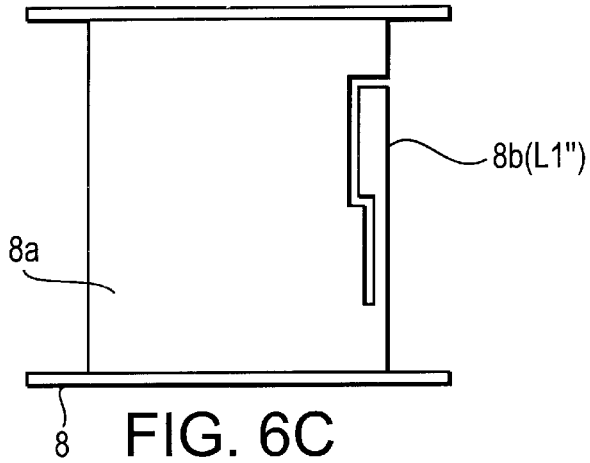
FIG. 6C shows a top view of a lower yoke of the isolator.

Each of FIGS. 6A, 6E, and 6C shows an isolator according to a third embodiment of the present invention. In the isolator, a part of a lower yoke 8 as a case is cut to form a tongue-shaped portion as An inductor L1" (8*b*). In the third embodiment, the same components as those shown in the first embodiment have the same reference numerals, and the explanation thereof will be omitted. Unlike the first embodiment, as mentioned above, the part of the lower yoke 8 is cut to form the inductor L1", and a recess 7*d*' is disposed instead of the cut-away portion 7*d* of the bottom wall 7*b*. In the bottom wall of the recess 7*d*', an electrode 75 for connecting the cold end of the capacitor C1 and the hot end to the inductor L1" insert-molded.

Since the lower yoke 8 is connected to ground terminals 73, substantially, the cold end of the inductor L1" is connected to the ground in the arrangement. As shown here, by forming the inductor L1" as a part of the lower yoke 8, when a series resonant circuit is formed by the inductor L1" and the capacitor C1, the number of used components can be reduced as compared to the case in which the chip inductor is used.

In this embodiment, although the resin frame 7 and the lower yoke 8 are separately formed, the lower yoke 8 is integrally formed in the resin frame 7 by insert-molding. In addition, although the cold end of the capacitor C1 and the hot end of the inductor L1" are connected to each other via the electrode insert-molded in the bottom wall of the resin frame, the cold end of the capacitor C1 and the hot end of the inductor L1" may be directly connected to each other by disposing a through-hole in the resin fine 7. In addition, the ground terminal may be disposed on the lower yoke 8.

In each to the first to third embodiments, a trap filter formed by a series resonant circuit is arranged only in tho side of the input/output terminal 71 (port P1). However, another trap filter formed by a series resonant circuit may also be formed in the side of the input/output terminal 72 (port P2). In this case, a resonance frequency of one of the series resonant circuits may he set to be twice the central frequency of a pass bandwidth of the isolator, whereas a resonance frequency of the other series resonant circuit may be set to be three times the central frequency of the pass bandwidth. With this arrangement, the second harmonic and third harmonic of a basic wave frequency can be efficiently attenuated. However, the present invention is not limited to these cases as long as the resonance frequency or each caries resonant circuit is greater than the central frequency of the pass bandwidth of the isolator. Alternatively, the resonance frequencies of both series resonant circuits may be the same.

Each of the above embodiments has used an isolator as the example. However, in the case of a circulator according to the present invention, instead of connecting the termination resistor R to the port P3 to a third central conductor, port P3 can be formed as a third input/output terminal. In this case, a trap filter composed P3, as a series resonant circuit may be connected to the port 23, as in the cases of the ports P1 and P2. Alternatively, the port P3 may be directly connected to a capacitor C3 and an input/output terminal.

When the series resonant circuit is disposed at the port P3, a resonance frequency of the series resonant circuit may be the same as one of the resonance frequencies of series resonant circuit disposed at the ports P1 and P2, or it may be set as a third resonance frequency different than the two resonance frequencies. The resonance frequencies of all three ports may be the same.

Of the three ports, a signal input from each input/output terminal of a circulator passes through two ports, that is, a port of a terminal to which the signal is input and another port of another terminal from which the signal is output. In this situation, series resonant circuits disposed at each of the two ports through which the signal passes functions as a trap filter for the signal. Therefore, when different signals pass through each path in the circulator, the spurious components of signals can be efficiently removed by appropriately setting the resonance frequencies of the three series resonant circuits based on the spurious components and the basic wave frequencies of the signals through each path.

Furthermore, the entire structure of the nonreciprocal circuit device in accordance with the present invention is not limited to those shown in FIGS. 1 to 6. For example, the present invention may be applied to a structure in which central conductors are formed inside a multi-layer substrate.

Figure 7:
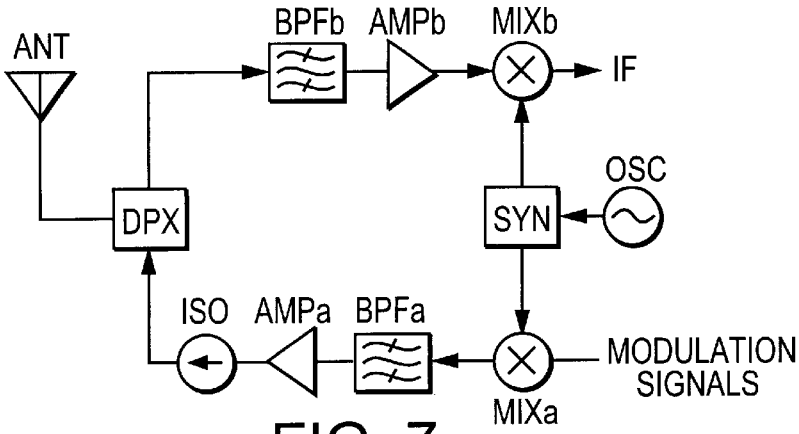
FIG. 7 shows a block diagram illustrating a structure of a communication apparatus according to a fourth embodiment of the invention.

Next, a communication apparatus incorporating the above isolator of the invention will be illustrated with reference to FIG. 7. In this figure, the reference character ANT denotes a transmission/reception antenna, the reference character DPX denotes a duplexer, the reference characters BPFa, BPFb, and BPFc denote band pass filters. The reference characters AMPa and AMPb denote amplifiers, the reference characters MIXa and MIXb denote mixers, the reference character OSC denotes an oscillator, and the reference character SYN denotes a frequency synthesizer. The MIXa modulates a frequency signal supplied from the SYN with a modulation signal, the BPFa passes through only the signals of a transmission-frequency band, and the AMPa amplifies the signals received from the BPFa, and the signals are transmitted from the ANT via an isolator ISO and the DPX. Of the signals outputted from the DPX, the BPFb passes through only the signals of a reception-frequency band, and the AMPb amplifies the signals. The MIXb mixes frequency signals outputted from the SYN and the received signals and outputs intermediate frequency signals IF.

As the isolator ISO, the device shown in each of FIGS. 1 to 6 and the like can be used. The isolator also has band elimination characteristics or low pass characteristics. Thus, the band pass filter BPFa permitting only the signals of the transmission-frequency band to pass through may be omitted. In this manner, all overall compact communication apparatus can be obtained.

As described above, according to the invention, between the central conductor and the ground terminal, the series resonant circuit living a resonance frequency higher than the central frequency of a pass bandwidth of the device is arranged. As a result, spurious components likely to be generated at frequencies higher than the central frequency of the pass bandwidth can be efficiently attenuated. In this way, by setting the resonance frequency higher than the central frequency of the pass bandwidth, the compact inductor and capacitor can be used. Moreover, by disposing the inductor on the cold-end side of the capacitor, the nonreciprocal circuit device can be miniaturized.

When a chip inductor is stacked on the capacitor, the circuit device can be miniaturized and the manufacturing process can be simplified.

As the inductor, when an electrode is insert-molded in a resin frame, the number of used components can be reduced. As a result, the nonreciprocal circuit device can be miniaturized and the manufacturing process can be simplified.

In addition, since the inductor is formed by cutting a part of a yoke, the number of used components can also be reduced, thereby contributing to miniaturization of the nonreciprocal circuit device and simplification of the manufacturing process.

When the capacitor is directly connected to the hot end of the inductor, the structure of the circuit device and the manufacturing process can be simplified, and the circuit device can be made compact.

In addition, in this invention, since the number of used components is reduced and the circuit device is made compact, increases in unnecessary impedance generated between the inductor and the ground terminal can be suppressed.

Moreover, when series resonant circuits are arranged for the plurality of central conductors, spurious components present having frequencies distant from the basic wave frequency an be efficiently attenuated. When resonance frequencies of the series resonant circuits are set to be substantially twice the basic wave frequency and substantially three times as high as that, the second harmonic and the third harmonic as spurious components having large signal levels can be efficiently attenuated.

In addition, in this invention, since the series resonant circuit can be used as the matching capacitance of a matching circuit, it is unnecessary to dispose another matching capacitance. Thus, the manufacturing process can be simplified and the circuit device can be miniaturized.

Moreover, since the present invention can improve spurious characteristics, the nonreciprocal circuit device can be miniaturized while suppressing unnecessary radiation from the device.

While preferred embodiments of the present invention have been described above, it is understood that various modifications and changes can be made within the spirit and scope of the invention as hereinafter claimed.

What is claimed is:

1. A nonreciprocal circuit device comprising:

a magnetic member for receiving a direct-current magnetic field, said magnetic member including a plurality of central conductors arranged to intersect one another; and a series resonant circuit including a capacitor and an inductor, the series resonant circuit being connected between at least one of the central conductors and a ground and having a resonance frequency greater than the central frequency of a pass bandwidth of the nonreciprocal circuit device;

wherein the series resonant circuit is formed by a cold end of the capacitor directly connected to a hot end of the inductor.

2. A nonreciprocal circuit device according to claim 1, wherein the inductor is a chip inductor.

3. A nonreciprocal circuit device according to claims 1 or 2, wherein series resonant circuits are disposed between two or more central conductors and ground terminals.

4. A nonreciprocal circuit device according to claim 3, wherein at least one of the two or more series resonant circuits has a resonance frequency different from a resonance frequency of the remaining series resonant circuit.

5. A nonreciprocal circuit device according to claim 4, wherein at least one of the series resonant circuits has a resonance frequency that is substantially twice the central frequency of the pass bandwidth, and at least another series resonant circuit has a resonance frequency that is substantially three times the central frequency of the pass bandwidth.

6. A nonreciprocal circuit device according to claims 1 or 2, wherein an equivalent capacitance of the series resonant circuit at the central frequency of the pass bandwidth is set as a matching capacitance with respect to the central frequency of the pass bandwidth.

7. A communication apparatus incorporating the nonreciprocal circuit device according to claims 1 or 2.

8. A nonreciprocal circuit device according to claim 3, wherein at least one of the series resonant circuits has a resonance frequency that is substantially twice the central frequency of the pass bandwidth, and at least another series resonant circuit has a resonance frequency that is substantially three times the central frequency of the pass bandwidth.

* * * * *